US006691716B2

(12) United States Patent
Neuner et al.

(10) Patent No.: US 6,691,716 B2
(45) Date of Patent: Feb. 17, 2004

(54) DISC ARRAY MASCARA APPLICATOR

(75) Inventors: Charles P. Neuner, Amityville, NY (US); Herve F. Bouix, New York, NY (US)

(73) Assignee: Color Access, Inc., Milville, NY (US)

( * ) Notice: Subject to any disclaimer, the term of this patent is extended or adjusted under 35 U.S.C. 154(b) by 0 days.

(21) Appl. No.: 10/052,086

(22) Filed: Jan. 17, 2002

(65) Prior Publication Data

US 2002/0059942 A1 May 23, 2002

Related U.S. Application Data

(63) Continuation-in-part of application No. 09/021,391, filed on Aug. 21, 2001, now Pat. No. 6,345,626.

(51) Int. Cl.[7] ..... A45D 40/26

(52) U.S. Cl. ..... 132/218; 132/317; 132/320

(58) Field of Search ..... 132/218, 216, 132/308, 313, 317, 320; 401/126, 127, 129; 15/207.2, 160

(56) References Cited

U.S. PATENT DOCUMENTS

| | | | | | |
|---|---|---|---|---|---|
| 2,180,533 | A | * | 11/1939 | Leffler | 604/289 |
| 2,460,548 | A | * | 2/1949 | Stewart | 132/151 |
| 2,515,094 | A | | 7/1950 | Price | 132/153 |
| 2,625,159 | A | * | 1/1953 | Roehrich | 604/93.01 |
| 3,130,735 | A | * | 4/1964 | Clark | 401/128 |
| 3,256,980 | A | * | 6/1966 | Bau | 401/75 |
| 3,363,635 | A | * | 1/1968 | Wurmbock | 132/218 |
| 3,892,248 | A | | 7/1975 | Kingsford | 132/88.7 |
| 3,896,823 | A | | 7/1975 | Spatz | 132/88.7 |
| 3,930,280 | A | | 1/1976 | Vasas | 15/257.05 |
| 3,939,520 | A | * | 2/1976 | Axelsson | 15/167 R |
| 3,998,235 | A | | 12/1976 | Kingsford | 132/88.5 |
| 4,404,977 | A | | 9/1983 | Vasas | 132/88.7 |
| 4,411,282 | A | | 10/1983 | Wavering | 132/88.5 |
| 4,422,986 | A | | 12/1983 | Cole | 264/39 |
| 4,446,880 | A | | 5/1984 | Gueret et al. | 132/88.5 |
| 4,527,575 | A | | 7/1985 | Vasas | 132/88.7 |
| 4,572,224 | A | | 2/1986 | Rosenwinkel et al. | 132/88.5 |
| 4,632,136 | A | | 12/1986 | Kingsford | 132/88.7 |
| 4,733,425 | A | | 3/1988 | Hartel et al. | 15/206 |
| 4,744,377 | A | * | 5/1988 | Dolan, Jr. | 132/218 |
| 4,861,179 | A | | 8/1989 | Schrepf et al. | 401/129 |
| 4,887,622 | A | | 12/1989 | Gueret | 132/320 |
| 4,898,193 | A | | 2/1990 | Gueret | 132/218 |
| 4,927,281 | A | | 5/1990 | Gueret | 401/129 |
| 4,974,612 | A | | 12/1990 | Gueret | 132/218 |
| 4,993,440 | A | | 2/1991 | Gueret | 132/218 |
| 5,094,254 | A | * | 3/1992 | Krueckel et al. | 132/218 |
| 5,197,497 | A | | 3/1993 | Gueret | 132/218 |
| 5,224,787 | A | * | 7/1993 | Vasas | 401/119 |
| 5,238,011 | A | | 8/1993 | Gueret | 132/218 |
| 5,247,951 | A | * | 9/1993 | Machida et al. | 132/218 |
| 5,370,141 | A | | 12/1994 | Gueret | 132/218 |
| 5,542,439 | A | | 8/1996 | Gueret | 132/218 |
| 5,588,450 | A | | 12/1996 | Gueret | 132/218 |
| 5,722,436 | A | | 3/1998 | Vandromme et al. | 132/218 |
| 5,816,728 | A | | 10/1998 | Nardolillo et al. | 401/126 |
| 5,826,600 | A | | 10/1998 | Rowe et al. | 132/317 |
| 6,158,912 | A | | 12/2000 | Miraglia et al. | 401/129 |
| D445,573 | S | * | 7/2001 | Naghibi | D4/136 |
| 6,260,558 | B1 | * | 7/2001 | Neuner | 132/218 |

* cited by examiner

*Primary Examiner*—Eduardo C. Robert
*Assistant Examiner*—David Comstock
(74) *Attorney, Agent, or Firm*—Martin H. Haerter, Esq.

(57) ABSTRACT

A disc-type cosmetic applicator has a plurality of individual discs connected by integrally molded springs to yield a single disc array. The space between the individual discs of the disc array is compressible during withdrawal from a container so that excess product can be removed from the applicator by a wiper. After passage through the wiper, the springs between the individual discs are biased to return to the array to a fully expanded position. The compressing of the discs during withdrawal allows a controlled amount of product to remain on the applicator for application by the consumer, and the returning of the discs to their expanded position by the spring causes the discs to assume a configuration which allows the applicator to effectively comb and separate the eyelashes. The single unit construction of the multi-disc array allows efficient and convenient assembly of a complete applicator by securing a single disc array to a conventional applicator stem with a simple pin.

27 Claims, 3 Drawing Sheets

223
205
217
222
223
218

223
218
217
219
222
222

DISC ARRAY MASCARA APPLICATOR

CROSS REFERENCE TO RELATED APPLICATIONS

This is a continuation-in-part of U.S. Ser. No. 09/621,391, allowed on Aug. 21, 2001 now U.S. Pat. No. 6,345,626, and incorporated by reference herein in its entirety.

FIELD OF THE INVENTION

The present invention relates to applicators for mascara or similar pasty products. More particularly, the present invention relates to mascara applicators that employ disc arrays or disc-like arrays for the application of the mascara to eyelashes.

BACKGROUND OF THE INVENTION

Disc-like arrays for use as applicators of mascara or other pasty products are known, and for some applications may be favored over conventional brush-type applicators due to a generally lower manufacturing cost. However, unlike brush applicators, a problem with disc array applicators is that it may be difficult to meter the quantity of product on the applicator with the type of wipers found in conventional cosmetic packages. One applicator with a disc-like array that appears to address this problem, at least in part, is shown in U.S. Pat. No. 4,411,282 to Wavering. Wavering discloses a mascara applicator comprising a series of edge-tapered ring-like discs which are disposed as an axial array along a rod-like wand. The array of discs remains stationary relative to the rod, and each disc remains stationary relative to the array, but each disc has a flexible marginal edge and annular grooves are defined between discs. As the applicator is withdrawn through a wiper the marginal edges of the discs flex or deform sufficiently to remove some excess mascara. However, because only the marginal edge of each disc is flexible, control of the quantity of mascara removed may not be optimal.

U.S. Pat. No. 6,260,558 to Neuner discloses a mascara applicator comprised of a plurality of individually formed annular members (e.g., discs, sleeves, rings, beads, etc.) that are assembled into an array on a central shaft. The discs can be formed individually in a variety of configurations, and assembled in a variety of combinations to yield applicators having different characteristics. Disadvantageously, assembly of an array from a number of small, individual discs may require a higher level of precision and effort in manufacturing processes.

Accordingly, a disc array type mascara applicator is desired that can be simply and economically manufactured while providing an array capable of carrying an optimal amount of mascara product through a wiper, and applying that product on lashes.

SUMMARY OF THE INVENTION

A disc-type applicator is provided comprising an array of discs disposed on a supporting portion of an applicator shaft, e.g., between two stops on an applicator shaft. The array is formed or molded as a single piece with each disc integrally connected to the next by at least one resilient member in the form of a spring element or elastic extension. Each disc has a central aperture through which a pin secured on the distal end of the shaft is slidably disposed. The array is configured to occupy a first expanded position and a second compressed position on the supporting portion of the shaft. The array is preferably initially formed or molded to a length longer than a corresponding length of the supporting section of the shaft, i.e., longer than the distance between the two stops. When the relatively longer array is mounted on relatively shorter supporting portion of the shaft, the resilient members connecting adjacent discs are deformed or flexed sufficiently to bias the array toward the expanded position. In the expanded position, cosmetic product enters or is loaded in the gap or spacing between adjacent discs. The discs are dimensioned such that each disc encounters at least some resistance as it passes through a wiper. Thus, as the array is drawn through the wiper, the resilient members flex or deform to a predetermined degree as each disc passes through the wiper. In this way, as the applicator is withdrawn from a container, spacing between the disc in contact with the wiper and at least the next adjacent disc is temporarily compressed a predetermined amount. As a result, excess product is squeezed out from between discs where the wiper can strip the excess from the applicator. After passing through the wiper, the resilient members again bias the disc array toward the fully expanded position, with an appropriate quantity of product loaded between adjacent discs. Thus, the applicator is adapted to pass through the wiper such that a predetermined amount of product remains on the applicator, i.e., excess product is removed from the applicator. The amount of product left on the applicator can be predetermined by selecting the wiper dimension relative to the disc dimension in combination with the degree of biasing force provided by the resilient members between discs.

The benefits of the aforementioned applicator are readily apparent. First, the compressing of the array of discs during the withdrawal of the applicator from the container allows a controlled amount of product to remain on the applicator for application to lashes with reduced chance of dripping, clumping or smearing. Second, the biasing of the discs into their expanded position by the spring causes the discs to assume a configuration suitable for the effective application, combing and separating tasks. As an added benefit, the resilient members also provide additional surfaces and structure to the array that facilitate loading and transfer of cosmetic product to lashes. Finally, the arrangement provides for efficient and convenient manufacture and assembly of a complete cosmetic applicator by securing a single molded disc array having multiple discs to a conventional applicator stem with a simple pin. This yields a highly cost effective disc-type applicator with an array that is compressible to remove excess cosmetic before application.

BRIEF DESCRIPTION OF THE DRAWINGS

Other objects, features and advantages of the present invention will become evident from the following detailed description considered in light of the drawings, wherein.

DETAILED DESCRIPTION OF THE INVENTION

Figure 1:
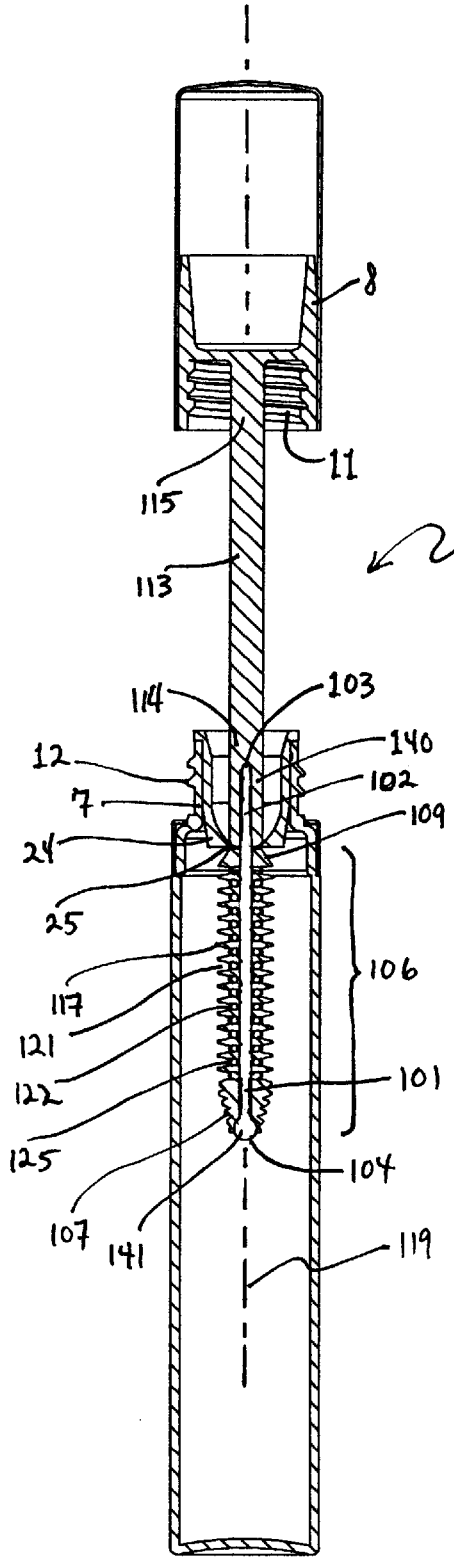
FIG. 1 is a sectional view of a disc-type applicator and container of the present invention having a disc array, wherein the disc array is in the expanded position.
Figure 2:
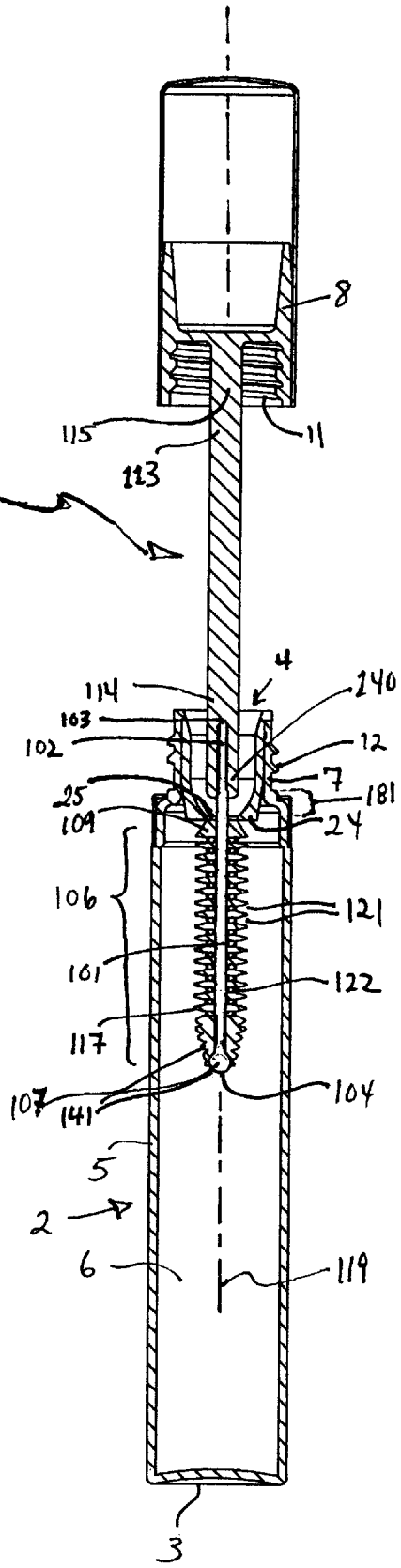
FIG. 2 is a sectional view of the disc-type applicator and container of FIG. 1, wherein the disc array is in the compressed position.
Figure 3:
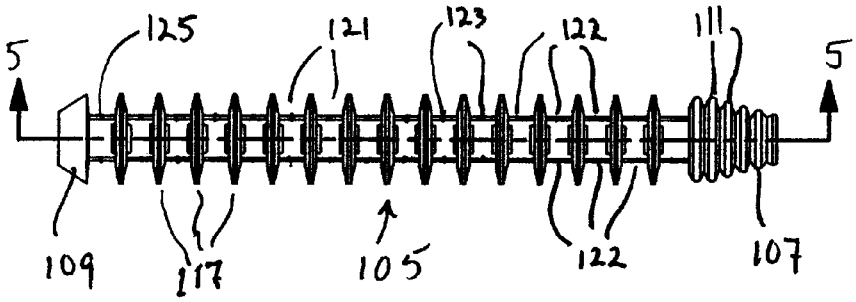
FIG. 3 is an elevation view of one embodiment of the disc array of the present invention.
Figure 4:
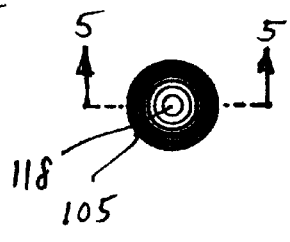
FIG. 4 is an end view of the disc array embodiment shown in FIG. 3.
Figure 5:
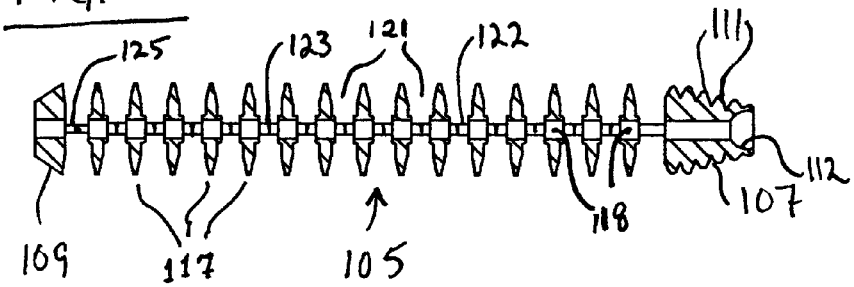
FIG. 5 is a sectional view of the disc array taken along lines 5—5 in FIGS. 3 and 4.

Referring now to the drawings, FIGS. 1 and 2 show cross-sectional views of a cosmetic package comprising a conventional container 2 and a disc applicator 116 according to the present invention. The conventional container 2 is of the type that is suitable for storing and dispensing a cosmetic product, such as, for example, mascara or hair color. In FIGS. 1 and 2, the disc applicator 116 is shown partially inserted in the conventional container 2. It will be understood that the applicator 16 may be more fully inserted in the container 2 for loading cosmetic product, or withdrawn and separated from the container 2 for convenient transfer and application of cosmetic to, for example, eyelashes or hair. The container 2 has a closed end 3, an open end 4, and a peripheral wall 5 which connects the closed end 3 to the open end 4 and defines a product storage compartment 6. The open end 4 is provided with a neck 7. A conventional wiper 24 is disposed in the neck 7. The wiper 24 can be a separately formed piece that is inserted into the neck 7 of the container, or the wiper can be an integrally molded structure that projects inwardly from an inner surface of the neck 7. Regardless of which structure is chosen, the wiper 24 defines an opening 25 through which at lease a portion of the applicator 116 passes when being inserted or withdrawn from the container. Ideally, the wiper 24 is dimensioned and adapted to remove excess cosmetic product from the applicator 116 as the applicator 116 is withdrawn from the container 2. The wiper is preferably made from a relatively flexible material, such as, for example, any one of a number of well known natural or synthetic rubbers or elastomers. Suitable materials for the wiper include, for example, relatively flexible forms of polyethylene, polypropylene, rubber, silicone, nylon, and the like.

To seal the open end of the container 2, the applicator 116 may include a closure 8 secured to a proximal end 115 of the applicator. The closure 8 is removably mounted to the neck 7 by, for example, complimentary threads 11, 12 projecting inwardly from an inner surface of the closure 8 and outwardly from an outer surface of the neck 7, respectively. It will be understood that the closure may be removably mounted on the container neck by means other than the opposing threads shown and described herein, such means being well known in the art and a matter of routine modification to the disclosed structure. Such alternate means include, for example, snap fit engagement, bayonet-type engagement, interference fit, etc.

The applicator 116 is further comprised of an elongated rod or stem 113 extending from the proximal end 115 to a distal end 114, thereby defining a longitudinal axis 119. Provided at distal end 114 of the elongated rod 113 is an applicator portion 106 which is adapted to be loaded with product in storage compartment 6, and to apply that product to, for example, eyelashes or hair. The applicator portion 106 is adapted to pass through the opening 25 of the wiper 24 as the applicator 116 is inserted and withdrawn from the container 2.

The applicator portion 106 of the present invention comprises an array 105 of individual discs 117, as shown in FIGS. 3–6. Each pair of adjacent discs 117 is connected by at least one resilient member 125 in the form of a spring element 122. In the preferred embodiment shown in FIGS. 1–6, each pair of adjacent discs 117 is connected by at least two resilient members 125 in the form of spring elements 122. The spring elements 122 are adapted to bias the individual discs 117 toward a spaced apart relationship. Thus, the spring elements 122 maintain a space 121 between adjacent discs 117. However, the spring elements are also sufficiently resilient to permit the space 121 between two adjacent discs 117 to be compressed upon the exertion of an external force on one or both of the discs. This characteristic of the array 105 is particularly important when the applicator 116 is withdrawn from the container 2 through the wiper 24.

The disc array 105 is mounted on a shaft or pin 101 extending from the distal end 114 of the stem 113. As seen more clearly in FIGS. 3–6, each individual disc 117 has a central aperture 118 through which the pin 101 is slidably disposed. The pin 101 may be an integrally molded extension of the distal end 114 of the stem 113. Alternatively, the pin 101 is separately formed of metal or plastic, and secured on the stem 113 after the disc array 105 is positioned on the pin. In the preferred embodiment, the pin 101 is made of metal, and has a first end 102 that is secured in a bore 103 in the distal end 114 of stem 113. A second end 104 of the pin 101 has an enlarged portion or stop 141 to retain the disc array 105 on the pin. Because the disc array 105 is slidably disposed on the pin 101, and each disc is free to move to a limited degree relative to adjacent discs, the disc array 105 can assume a first expanded position wherein the spacing 121 between adjacent disks is maximized, as seen in FIG. 1, and a second compressed position, as shown in FIG. 2, wherein the spacing 121 between at least some of the discs is reduced.

The disc array 105 is retained on the pin 101 by first and second stops 140, 141. In the preferred embodiment, the first stop 140 is provided by the distal end 14 of stem 13, which is larger in diameter than the pin 101 or the apertures 118. The second stop 141 is provided in the form of an enlarged portion of the distal end 104 of the pin. The first stop 140 and the second stop 141 define an area on the pin 101 within which movement of the disc array is restricted. The first stop and the second stop can be any physical structure which creates a barrier that will not allow the discs to pass when compressed or expanded, such as, for example, relief bumps which project outwardly from the rod, or the permanent adhering of the first and last discs in the array to the rod itself, or, as shown in FIG. 1, the pin 101 has a smaller diameter than the distal end of the stem. It will be evident to one skilled in the art that, in order to assemble the disc array on the pin, one of the stops must be formed on or secured to the applicator after the disc array is disposed on the pin. In the preferred embodiment, this is accomplished by inserting the pin 101 in the apertures 118 of the disc array 105, and then securing the first end 102 of the pin in the distal end 14 of the stem.

In the preferred embodiment, the resilient members 125, i.e., the spring elements 122, are resiliently flexible projections integrally molded with, and made of the same material as the discs. When the resilient members and the discs are made of the same material, it will be evident that the flexible nature of each resilient member is provided by its substantially smaller dimension relative to the thickness and structure of the discs. The integrally molded resilient members 125 must have a dimension sufficiently small to provide flexibility sufficient to permit compression of the spaces 121 between discs as the array passes through the wiper (i.e., to squeeze out excess product as the applicator is withdrawn from the container). At the same time, the resilient members 125 must have a dimension sufficiently large to resiliently bias adjacent discs apart to establish the spacing 121 between disks found in the expanded position. The proper dimensions of the resilient members 125 can be determined without undue experimentation with consideration given to the flexural properties of the material chosen for the array, and with consideration given to the amount of resistance provided by the wiper.

In addition, each resilient member 125 may be provided with structural details that control the resilience and/or flexibility of the member. For example, each spring element 122 may be provided with a crimp approximately at a midpoint in its length, the crimp acting as a flexible elbow or living hinge to encourage the spring element to fold at a particular point and in a particular direction, e.g., towards the pin. After a disc clears the wiper 24, the spring elements associated with that disc return to their original position and thus cause the array of discs to return to the fully expanded position. As noted above, the degree of compression of the space 121 between the individual discs 117 can be controlled, for example, by selecting a material and resilient member structure that will allow the discs to compress only to a certain point, thus controlling the space between the discs and the amount of product loaded therebetween after compression.

In the preferred embodiment, the disc array 105 also includes a tip element 107 and a tail element 109, each of which is integrally molded with the array and connected to a respective adjacent disc by at least one resilient member 125, also in the form of a spring element 122. The tip element 107 is tapered and provided with a series of ribs 111 such that it is useful as a touch-up tool to apply cosmetic to hard to reach places, e.g., lashes close to the corners of the eyes. The tapered tip facilitates entry of applicator into the container through the wiper. The tip element 107 also provides a more substantial structure to protect the distal end of the applicator from damage, and to accommodate a clearance 112 sized to receive the stop 141 of pin 101. The tail element 109 is tapered and dimensioned to slightly spread the wiper opening 25 as the applicator is withdrawn from the container such that the discs 117 can more easily pass through the wiper opening.

Materials suitable for making the closure 8, stem 113, container 2, individual discs 117 and/or the resilient members 125 include plastics, such as, for example, styrene, acetal, polyethylene (high or low density), polypropylene, nylon, polyvinyl chloride, polyethylene terephthlate, polycarbonate, acrylic, and the like. Preferably, for economy of manufacture, the disc array, including the individual discs 117 and connecting spring elements 122, is integrally molded in one shot from a single material. In the preferred embodiment, the disc array including the individual discs 117 and the spring elements 122 are made from a single material, LDPE (low density polyethylene).

As noted above, the array 105 is configured to occupy a first expanded position, shown in FIG. 1, and a second compressed position, shown in FIG. 2, on the applicator portion 106 of the applicator 116. The array 105 is preferably initially formed or molded to a first length longer than a second length defined between the two stops 140, 141. In this way, when the relatively longer array is mounted on the relatively shorter supporting portion of the shaft, the resilient members 125 between adjacent discs 117 are deformed or flexed at least slightly to bias the array toward the expanded position. In the expanded position, cosmetic product enters or is loaded in the spacing 121 between adjacent discs. The amount of product initially loaded on the applicator in the storage chamber 6 may be excessive. Accordingly, the discs 117, the wiper opening 25 and the resilient members 125 are dimensioned to cooperate to remove some of the product from spaces 121. The disk array and the wiper opening dimensions are selected such that each disc encounters at least some resistance as it passes through a wiper. Thus, as the array is drawn through the wiper as shown in FIG. 2, the spring arms 122 flex or deform as each disc passes through the wiper. In this way, as the applicator 116 is withdrawn from a container, spacing between a disc 117 (or tail element 109) and the next adjacent disc is temporarily compressed, and excess product is squeezed out from between discs to where the wiper can strip it from the applicator. As the disks 117 (or tail element 109) initially resist passing through the wiper opening 25, a gap will occur between the upper side of the tail element 109 and the lower edge of the distal end 114 of the rod 113, thus exposing a portion of the first end 102 of the pin 101 as indicated by bracket 181 in FIG. 2. After passing through the wiper, the resilient members 125 again bias the disc array toward the fully expanded position (similar to that shown in FIG. 1), with an appropriate quantity of product remaining between adjacent discs 117 for transport to and application on eyelashes. Thus, the applicator is adapted to pass through the wiper such that a predetermined amount of product remains on the applicator, i.e., excess product is removed from the applicator. The amount of product left on the applicator can be predetermined by selecting the wiper dimension relative to the disc dimension, with consideration given to the spacing provided by the resilient members 125 between discs 117.

Figure 6:
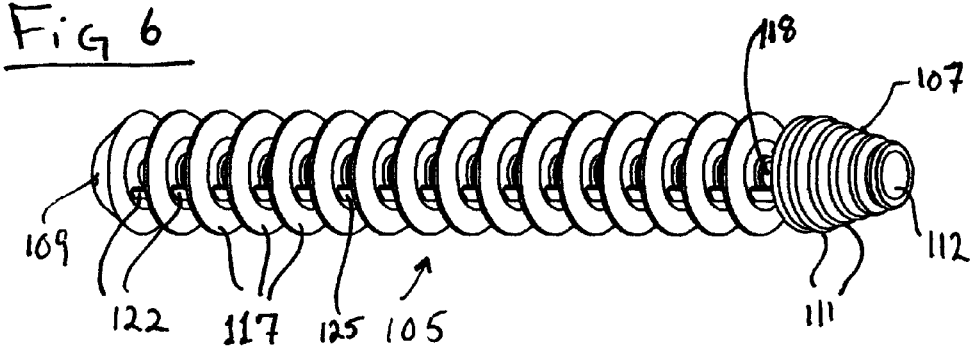
FIG. 6 is a perspective view of the disc array shown in FIGS. 3–5.
Figures 7, 8:
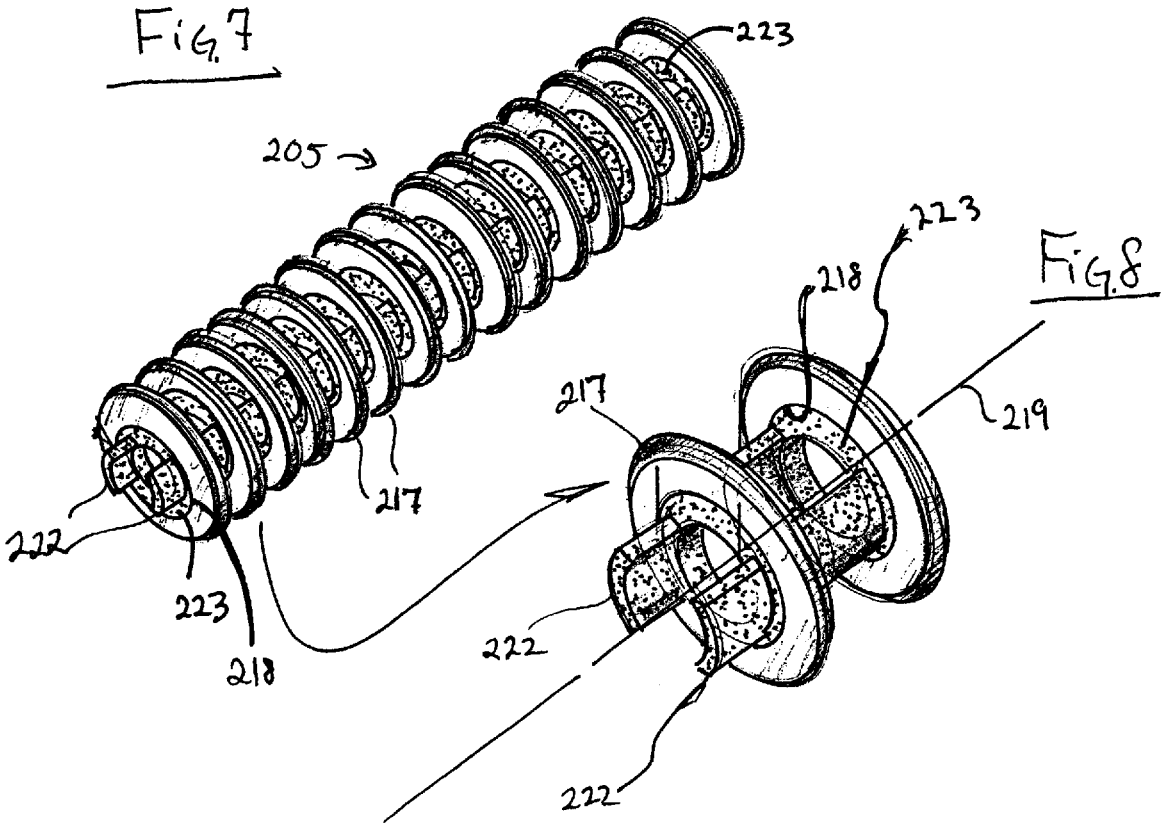
FIGS. 7 and 8 are perspective views of another disc array embodiment according to the invention.

An alternate embodiment of the array is shown in FIG. 6, designated generally as 205. It comprises individual discs 217 connected along a longitudinal axis 219 by resilient members 125 in the form of elastic portions 222 of an insert 223 secured in the central aperture 218 of each disc. The array 205, including the discs 217 and insert 223 with elastic portions 222 are bi-injection molded as a single unit. The process of bi-injection molding is a well known process which allows two or more materials to be substantially simultaneously injected into a single mold to obtain a single integrally formed component. The disks may be made of the same materials disclosed above. The insert 223 including the elastic portions 222 are made from suitable materials such as, for example, polyurethane, urethane foam, santoprene, silicone elastomers, rubbers, thermoplastic elastomers, and the like. The elastic portions 222 act as springs by compressing when a disc 217 contacts the wiper 24 as the applicator is withdrawn from the container, thus squeezing excess product from between discs 217. In each case, as each successive disc 217 clears the wiper 24, corresponding elastic portions 222 return to an uncompressed state. When sufficient elastic portions 222 are uncompressed, the array of discs 205 returns to its expanded position with an appropriate amount of product remaining between the discs 217 for application to lashes or hair. Similar to the spring element embodiment, the degree of compression of the discs can also be determined by appropriate material, shape and dimension selection. The determination of the compression will be a simple matter of selecting elastic portions to have a material, shape and dimension to provide desired compression characteristics suitable for the degree of resistance against the discs passing through the wiper. Thus, the space between the discs and the amount of product remaining between the discs can be predictably controlled. The disc array 205 is secured to the distal end of the rod of an applicator with a pin as described above with respect to the spring element embodiment.

The aforementioned applicators with resilient members 125 provided between adjacent discs yields at least the following advantages. First, the compressing of the spacing between discs during the withdrawal of the applicator from the container allows a controlled amount of product to remain on the applicator for application by the consumer. Second, the biasing of the discs into their expanded position by the springs causes the discs to assume a configuration that maximizes the effect of the applicator in applying cosmetic, and in combing and separating eyelashes. Most importantly, the disc arrays made according to the invention are made as a single unit in simple process, such as, for example, injection molding. Because the disc arrays are made as a single unit, a compressible disc-like applicator can be quickly and conveniently assembled by securing a single disc array to a conventional applicator stem with a simple pin. This highly efficient construction yields a low-cost applicator that has excellent product loading and application characteristics.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A disc array for use on a cosmetic applicator in connection with a cosmetic container having a wiper, the disc array comprising:

at least a first disc and a second disc, each having a central aperture; and at least one resilient member integrally molded with and connecting the first disc and the second disc, the resilient member connecting the first disc and the second disc such that the central aperture of the first disc is in alignment with the central aperture of the second disc and such that the first disc and the second disc are biased toward an expanded position defining a spacing between the first disc and the second disc;

wherein each disc is dimensioned to encounter at least some resistance when drawn through the wiper, and the resilient member in response to the resistance of the wiper is deformable to a predetermined degree sufficient to permit the spacing between the first disk and the second disk to be temporarily compressed.

2. The disc array of claim 1 wherein the resilient member is a spring element.

3. The disc array of claim 2 wherein the first disc, the second disc and the spring element are integrally molded from the same material.

4. The disc array of claim 3 wherein the material is a plastic material selected from one of styrene, acetal, high density polyethylene, low density polyethylene, polypropylene, nylon, polyvinyl chloride, polyethylene terephthlate, polycarbonate and acrylic.

5. The disc array of claim 4 wherein the plastic material is low density polyethylene.

6. The disc array of claim 1 wherein the resilient member is an elastic portion of an insert secured in the respective central aperture of each of the first disc and the second disc.

7. The disc array of claim 6 wherein the first disc and the second disc are made from a plastic material selected from one of styrene, acetal, high density polyethylene, low density polyethylene, polypropylene, nylon, polyvinyl chloride, polyethylene terephthlate, polycarbonate and acrylic, and the insert including the elastic portion are made from a material selected from one of polyurethane, urethane foam, santoprene, silicone elastomers, rubbers and thermoplastic elastomers.

8. The disc array of claim 6 wherein the elastic portion and the insert are integrally molded with the first disc and the second disc by bi-injection molding.

9. The disc array of claim 1 further comprising a tip element integrally molded to a distal end of the array, the tip element having a central aperture corresponding in dimension and alignment with the central aperture of the first disc and the second disk, the tip element tapered to facilitate passage of the array through a cosmetic wiper.

10. The disc array of claim 9 wherein the tip element further comprises annular ribs.

11. The disc army of claim 1 further comprising a tail element integrally molded to a proximal end of the array, the tail element having a central aperture corresponding in dimension and alignment with the central aperture of the first disc and the second disk, the tail element tapered to facilitate withdrawal of the array through a cosmetic wiper.

12. A disc array for use on a cosmetic applicator in connection with a cosmetic container having a wiper, the disc array comprising:

a plurality of discs, each having a central aperture; and a plurality of resilient members integrally molded with and connecting the plurality of discs such that the central aperture of each disc is in alignment with the central aperture of an adjacent disc and such that the plurality of discs are biased toward an expanded position defining a spacing between each disc and the adjacent disc, wherein each disc is dimensioned to encounter at least some resistance when drawn through the wiper, and the resilient member in response to the resistance of the wiper is deformable to a predetermined degree sufficient to permit the spacing between each disk and the adjacent disk to be temporarily compressed.

13. A cosmetic applicator for use in connection with a cosmetic container having a wiper, the cosmetic applicator comprising:

an elongated rod having a distal end and a proximal end defining a longitudinal axis, the distal end having a bore aligned with the longitudinal axis;

a disc array comprising;

at least a first disc and a second disc, each having a central aperture; and at least one resilient member integrally molded with and connecting the first disc and the second disc, the at least one resilient member connecting the first disc and the second disc such that the central aperture of the first disc is in alignment with the central aperture of the second disc along the longitudinal axis and such that the first disc and the second disc are biased toward an expanded position defining a spacing between the first disc and the second disc;

wherein each disc is dimensioned to encounter at least some resistance when drawn through the wiper, and the resilient member in response to the resistance of the wiper is deformable to a predetermined degree sufficient to permit the spacing between the first disk and the second disk to be temporarily compressed; and a pin securing the disc array to the rod, the pin slidably received through the central aperture of each disc and a first end of the pin secured in the bore in the distal end of the rod; and means for retaining the disc array on the pin.

14. The cosmetic applicator of claim 13 wherein the means for retaining the disc array on the pin comprises a distal stop on a second end of the pin, the distal stop having a dimension greater than a diameter of the central aperture.

15. The cosmetic applicator of claim 14 wherein the distal stop comprises an enlarged portion of the second end of the pin.

16. The cosmetic applicator of claim 13 wherein the means for retaining the disc array on the pin comprises a proximal stop at the first end of the pin, the proximal stop having a dimension greater than a diameter of the central aperture.

17. The cosmetic applicator of claim 16 wherein the proximal stop comprises a portion of the distal end of the rod.

18. The cosmetic applicator of claim 13 wherein the resilient member is a spring element.

19. The cosmetic applicator of claim 18 wherein the first disc, the second disc and the spring element are integrally molded from the same material.

20. The cosmetic applicator of claim 19 wherein the material is a plastic material selected from one of styrene, acetal, high density polyethylene, low density polyethylene, polypropylene, nylon, polyvinyl chloride, polyethylene terephthlate, polycarbonate and acrylic.

21. The cosmetic applicator of claim 20 wherein the plastic material is low density polyethylene.

22. The cosmetic applicator of claim 13 wherein the resilient member is an elastic portion of an insert secured in the respective central aperture of each of the first disc and the second disc.

23. The cosmetic applicator of claim 22 wherein the first disc and the second disc are made from a plastic material selected from one of styrene, acetal, high density polyethylene, low density polyethylene, polypropylene, nylon, polyvinyl chloride, polyethylene terephthlate, polycarbonate and acrylic, and the insert including the elastic portion are made from a material selected from one of polyurethane, urethane foam, santoprene, silicone elastomers, rubbers and thermoplastic elastomers.

24. The cosmetic applicator of claim 22 wherein the elastic portion and the insert are integrally molded with the first disc and the second disc by bi-injection molding.

25. The cosmetic applicator of claim 13 further comprising a tip element integrally molded to a distal end of the array, the tip element having a central aperture corresponding in dimension and alignment with the central aperture of the first disc and the second disk, the tip element tapered to facilitate passage of the array through a cosmetic wiper.

26. The cosmetic applicator of claim 25 wherein the tip element further comprises annular ribs.

27. The cosmetic applicator of claim 13 further comprising a tail element integrally molded to a proximal end of the array, the tail element having a central aperture corresponding in dimension and alignment with the central aperture of the first disc and the second disk, the tail element tapered to facilitate withdrawal of the array through a cosmetic wiper.

* * * * *